US010265992B2

(12) United States Patent
Canner et al.

(10) Patent No.: US 10,265,992 B2
(45) Date of Patent: Apr. 23, 2019

(54) NOTEBOOK AND NOTEBOOK COVER

(71) Applicant: Polyconcept North America, New Kensington, PA (US)

(72) Inventors: Gary Charles Canner, Pittsburgh, PA (US); Luo Xian Yu, Shanghai (CN)

(73) Assignee: Polyconcept North America, New Kensington, PA (US)

( * ) Notice: Subject to any disclaimer, the term of this patent is extended or adjusted under 35 U.S.C. 154(b) by 0 days.

(21) Appl. No.: 15/079,444

(22) Filed: Mar. 24, 2016

(65) Prior Publication Data

US 2016/0303887 A1 Oct. 20, 2016

Related U.S. Application Data

(60) Provisional application No. 62/139,303, filed on Mar. 27, 2015.

(51) Int. Cl.

| | |
|---|---|
| ***B42D 3/06*** | (2006.01) |
| ***B42D 3/12*** | (2006.01) |
| ***B42D 3/18*** | (2006.01) |
| ***B42D 5/00*** | (2006.01) |
| ***B42B 5/00*** | (2006.01) |
| ***B42B 5/12*** | (2006.01) |
| ***B42D 3/10*** | (2006.01) |
| ***B42F 13/00*** | (2006.01) |

(52) U.S. Cl.

CPC ..... *B42D 3/06* (2013.01); *B42B 5/00* (2013.01); *B42B 5/12* (2013.01); *B42D 3/10* (2013.01); *B42D 3/126* (2013.01); *B42D 3/18* (2013.01); *B42D 5/003* (2013.01); *B42F 13/002* (2013.01)

(58) Field of Classification Search

CPC ..... B42D 3/06; B42D 3/126
USPC ..... 281/30, 33, 35
See application file for complete search history.

(56) References Cited

U.S. PATENT DOCUMENTS

| | | | | |
|---|---|---|---|---|
| 2002/0027357 A1* | 3/2002 | Lake | B42F 9/002 | 281/30 |
| 2003/0047935 A1* | 3/2003 | Romiti | B42D 3/10 | 281/35 |

FOREIGN PATENT DOCUMENTS

| | | | | |
|---|---|---|---|---|
| DE | 1147561 B * | 4/1963 | B42D 3/06 | |
| FR | 1225131 A * | 6/1960 | B42D 3/06 | |
| GB | 876751 A * | 9/1961 | B42D 3/06 | |
| WO | WO 2013062273 A2 * | 5/2013 | B42F 7/065 | |

* cited by examiner

*Primary Examiner* — Kyle R Grabowski
(74) *Attorney, Agent, or Firm* — Cohen & Grigsby, PC

(57) ABSTRACT

A notebook may generally comprise a plurality of sheets of paper, a binding mechanism binding the plurality of sheets together, and a cover bound to the plurality of sheets of paper disposed therebetween, the cover comprising first and second opposed covers, the first cover including a first portion and a second portion and having a hinge line extending therebetween, wherein the second portion is pivotable about the hinge line between a closed position and an open position. A notebook cover is also described.

12 Claims, 4 Drawing Sheets

NOTEBOOK AND NOTEBOOK COVER

CROSS REFERENCE TO RELATED APPLICATION

This application claims the benefit of U.S. Provisional Application No. 62/139,303, filed Mar. 27, 2015, which is incorporated herein by reference in its entirety.

BACKGROUND

This disclosure generally relates to notebooks and notebook covers.

Notebooks may generally comprise a plurality of sheets of paper between a cover and connected by a binding mechanism. Notebook covers may comprise rigid, i.e., not flexible, natural and/or synthetic materials. Notebooks may be convenient for writing and reading when placed on a flat surface. However, notebooks and notebook covers may be difficult to open and manipulate when held in a user's hands because of the rigid cover. The back notebook cover may support the sheets of paper for writing and reading purposes, but may be subjected to greater wear relative to the front notebook cover when opened and manipulated by the user. Therefore, more efficient notebooks and notebook covers are desirable.

SUMMARY

In various embodiments, more efficient notebooks and notebook covers are described.

A notebook may generally comprise a plurality of sheets of paper, a binding mechanism binding the plurality of sheets together, and a cover bound to the plurality of sheets of paper disposed therebetween, the cover comprising first and second opposed covers, the first cover including a first portion and a second portion and having a hinge line extending therebetween, wherein the second portion is pivotable about the hinge line between a closed position and an open position.

A notebook cover may generally comprises first and second opposed covers, the first cover including a first portion and a second portion and having a hinge line extending therebetween, wherein the second portion is pivotable about the hinge line between a closed position and an open position.

BRIEF DESCRIPTION OF THE DRAWINGS

The various embodiments described herein may be better understood by considering the following description in conjunction with the accompanying drawings.

DESCRIPTION

Figure 3:
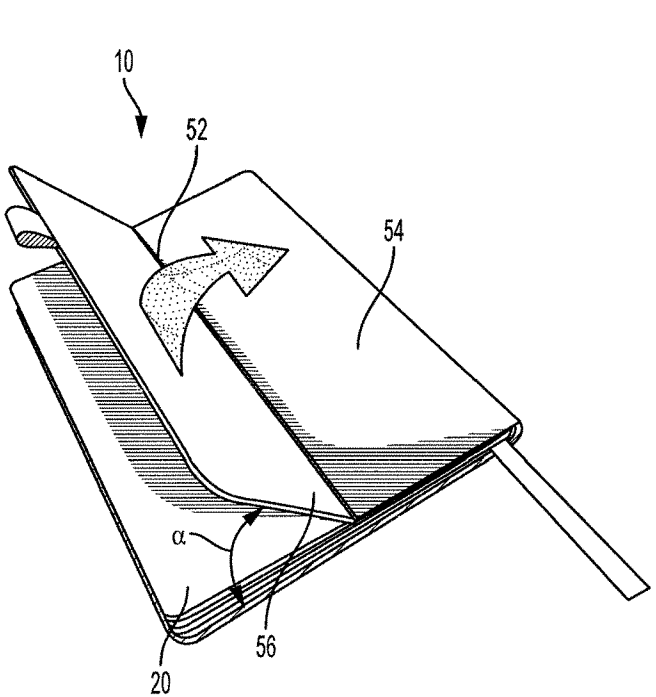
FIGS. 3-5 include back perspective views of the notebook of FIG. 1.

All numerical quantities stated herein are approximate, unless indicated otherwise, and are to be understood as being prefaced and modified in all instances by the term "about". The numerical quantities disclosed herein are to be understood as not being strictly limited to the exact numerical values recited. Instead, unless indicated otherwise, each numerical value included in the present disclosure is intended to mean both the recited value and a functionally equivalent range surrounding that value.

All numerical ranges recited herein include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value equal to or less than 10.

As generally used herein, the articles "one", "a", "an", and "the" refer to include "at least one" or "one or more" of what is claimed or described, unless indicated otherwise. For example, "a component" means one or more components, and thus, possibly, more than one component is contemplated and may be employed or used in an implementation of the described embodiments.

As generally used herein, the terms "include", "includes", and "including" are meant to be non-limiting.

As generally used herein, the terms "have", "has", and "having" are meant to be non-limiting.

As generally used herein, the term "notebook" refers to articles comprising one sheet or a plurality of sheets of paper or other sheets coupled and/or bound together and enclosed by a cover. The notebook and notebook cover described herein may be usable for notebooks, journals, sketch books, diaries, planners, calendars, address books, memo books, books, booklets, pamphlets, and binders, for example.

The sheets of paper may include a plurality of writing guide formats located thereon, including, but not limited to, lined, dated, blank, graph, or any combinations thereof. The writing guide formats may include a dated calendar, an undated planner, an expense log, or an address book, for example. The writing guide formats may be present on one or both sides of each sheet. The sheets may include a tear line extending along the inner longitudinal edge of the sheets adjacent to the spine and/or binding mechanism such that each sheet may be torn along the tear line and thereby be separated from the notebook.

The notebook may comprise a binding mechanism to bind a plurality of sheets of paper together and/or the notebook cover and one sheet or the plurality of sheets of paper. The notebook cover may include a binding mechanism on an inner surface of the front cover, back cover, and/or spine. The binding mechanism may be a wire (e.g., coil or spiral) binding mechanism, an adhesive binding mechanism, one-, two-, or three-ring binders, prong binding systems, case binding mechanisms, perfect binding mechanisms, stitched binding mechanisms and/or other binding mechanism. The binding mechanism may comprise, for example, saddle stitch binding mechanisms and casewrap binding mechanisms.

Referring to FIGS. 1-5, a notebook 10 may comprise one sheet or a plurality of sheets of paper 20 disposed between a notebook cover 30. The notebook cover 30 may generally comprise a front cover 40, a back cover 50, and a spine 60 between the front 40 and back 50 covers. Each of the covers 40, 50 and spine 60 may comprise a relatively rigid material and/or not flexible material, such as plastic, cardboard, paperboard, leather, metal, and combinations thereof. The rigid material may be covered by printed or embossed paper, plastic, or cloth to provide the notebook cover with a more attractive appearance. The plastic materials may include polyurethane and polyvinyl chloride, for example. The cover 30 may comprise cardboard wrapped in polyurethane, polyvinyl chloride, and/or faux leather paper.

The covers 40, 50 and spine 60 may comprise one sheet of material or a plurality of sheets of material cooperatively coupled and/or bound to form the notebook cover. The spine 60 may comprise a pair of opposed outer edges and each of the covers 40, 50 may be pivotally coupled to one of the edges, respectively. The notebook cover may lack a spine but comprise a front cover and a back cover cooperatively coupled by a binding mechanism to form the notebook cover. Each cover 40, 50 may include a binding edge adjacent to the spine 60 and/or binding mechanism and a free edge on a generally opposite side thereof.

Figure 2:
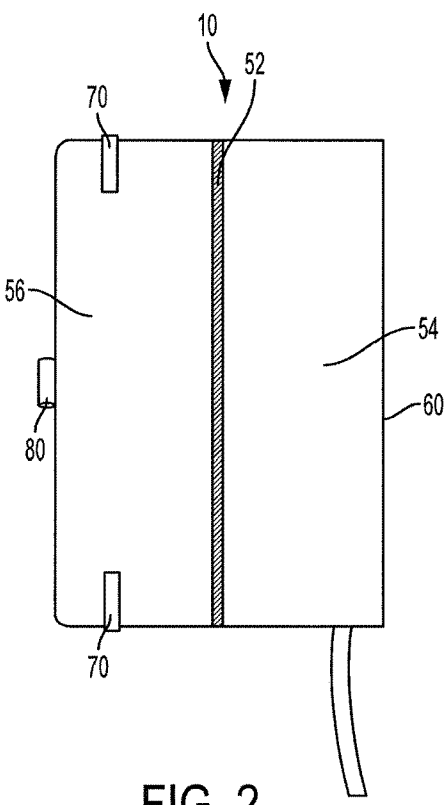
FIG. 2 includes a back view of the notebook of FIG. 1.

Referring to FIG. 2, the back cover 50 may comprise a hinge line 52 between the binding edge and free edge and dividing the back cover into an inner panel 54 and an outer panel 56. The outer panel 56 may comprise the same or different material, dimensions, and/or stiffness as the inner panel 54, front cover 40, and/or spine 60. The hinge line 52 may comprise a score line, fold line, or crease. The outer panel 56 may be integrally formed with the inner panel 54 or comprise a separate piece of material coupled to the inner panel 54 by a binding mechanism. For example, the hinge line 52 may be debossed or flexed such that the outer panel 56 is integrally formed with the inner panel 54.

The hinge line 52 may extend longitudinally from a top edge to a bottom edge of the back cover 50. The hinge line 52 may be centrally disposed between the binding edge and free edge of the back cover 50. The hinge line may be disposed between a central axis extending longitudinally from a top edge to a bottom edge of the back cover and the free edge of the back cover. The hinge line may be disposed between a central axis extending longitudinally from a top edge to a bottom edge of the back cover and the binding edge of the back cover. The hinge line may extend diagonally from one of the top edge and bottom edge to one of the binding edge and free edge of the back cover. For example, the hinge line may extend diagonally from the top edge to the binding edge of the back cover. The back cover may comprise more than one hinge line as described herein, such as a hinge line extending longitudinally and a hinge line extending diagonally in a direction generally and to the binding edge. Rather than being located on the back cover 50, the hinge line 52 may be instead or in addition be disposed on the front cover 40. The inner panel may comprise a similar hinge line dividing the inner panel into multiple sections.

Figure 5:
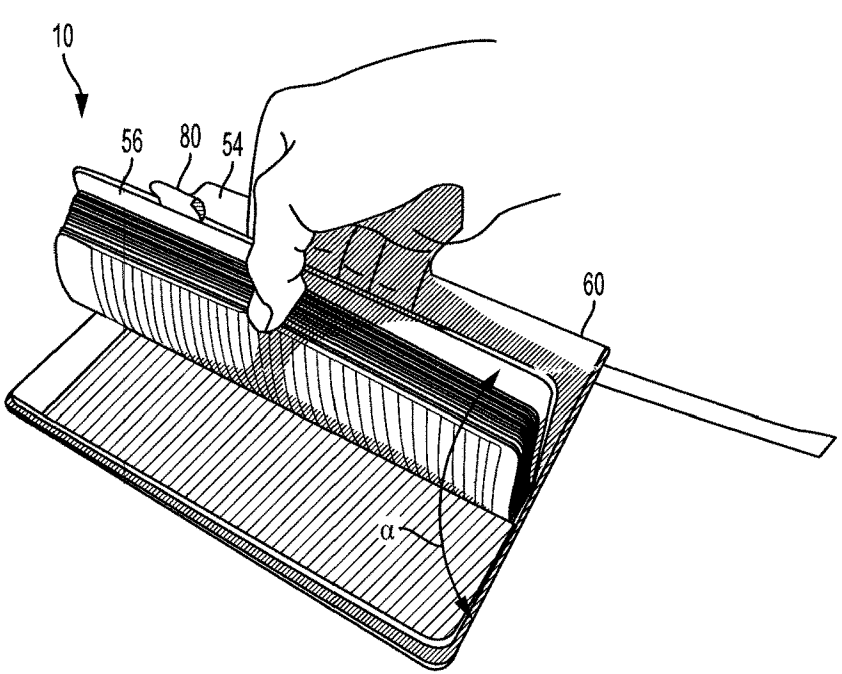
Figure 4:
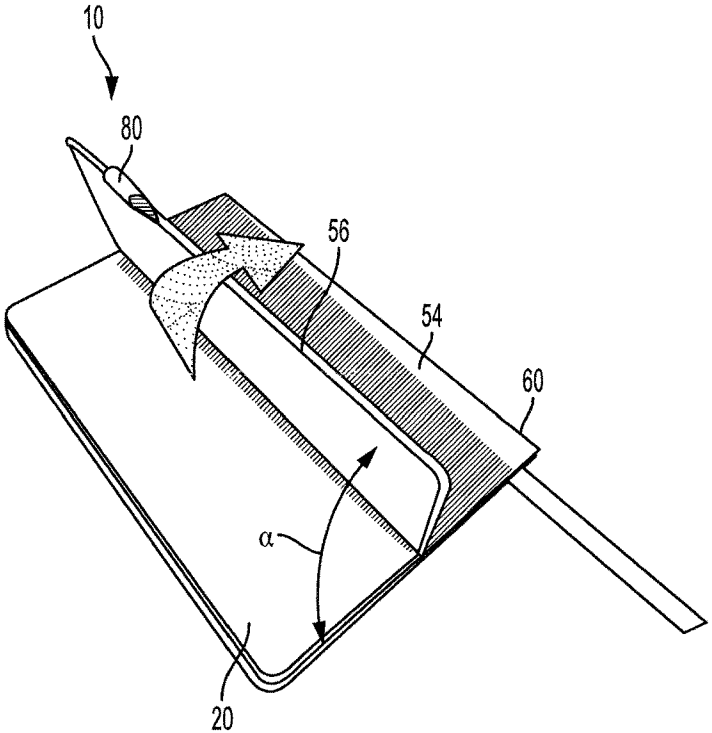
Figure 6:
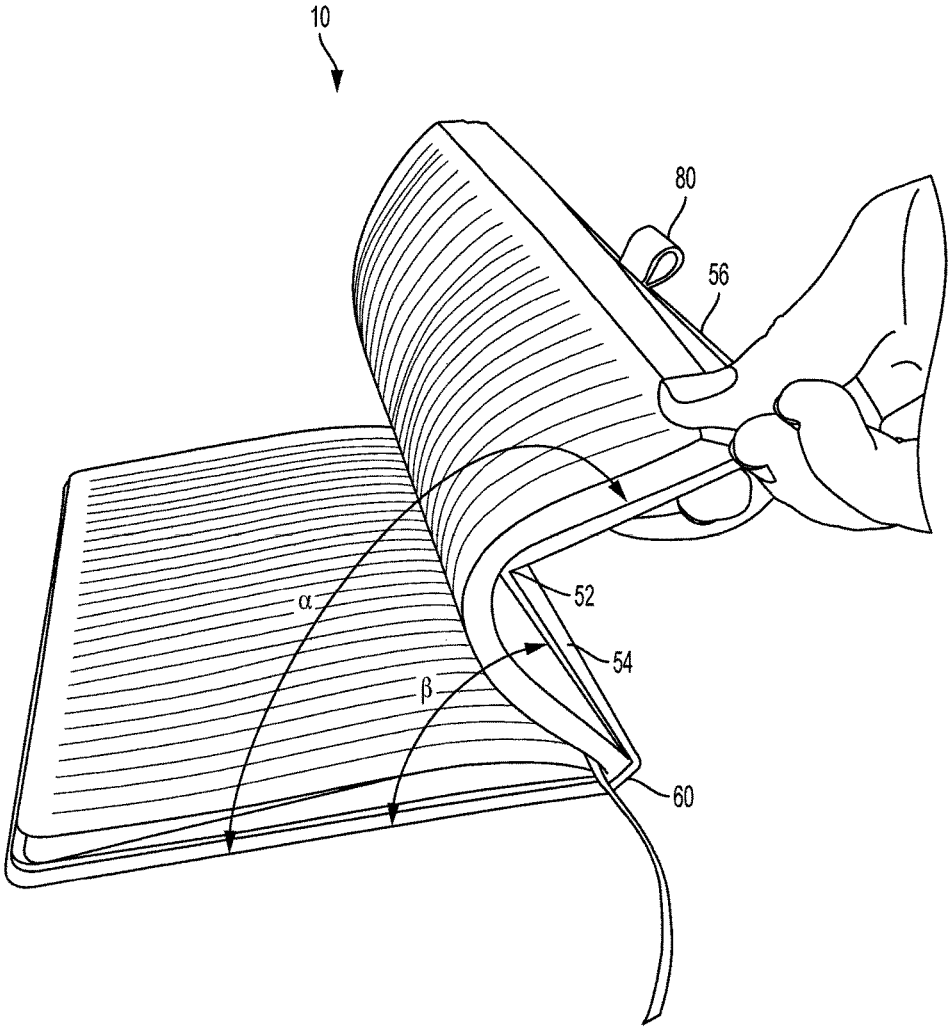
FIGS. 6-7 include perspective views of the notebook of FIG. 1.
Figure 7:
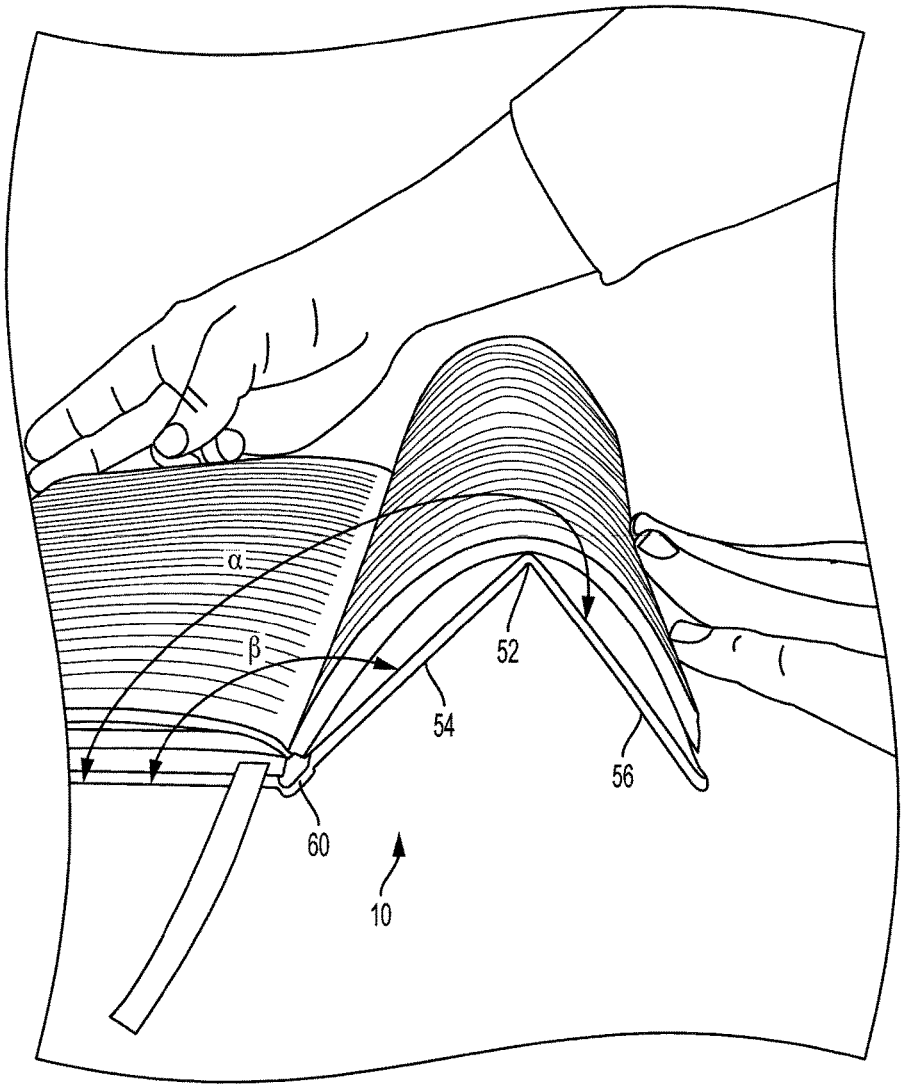

Referring to FIGS. 3-5, the outer panel 56 may pivot along the hinge line 52 in a forward direction (e.g., an angle less than 0°) and a backward direction (e.g., an angle greater than 0°) relative to a plane including the inner panel 54. The inner panel 54 may pivot along the binding edge in a backward direction (e.g., an angle greater than 0°) relative to a plane including the front cover 40. The outer panel 56 may pivot along the hinge line 52 from an angle $\alpha$ of −90° to 270°, and the inner panel 54 may pivot along the binding edge from an angle $\beta$ of 0° to 270°. The angles $\alpha$ and $\beta$ are measured from an axis extending from the binding edge to the free edge.

The outer panel 56 may pivot along the hinge line 52 from a minimum angle $\alpha$ of −90°, −10°, or 0° when in a closed position to a maximum angle $\alpha$ of 180° or 270° when in an open position. The outer panel 56 may pivot along the hinge line 52 from an angle $\alpha$ −90° to 180°, −10° to 180°, 0° to 180°, 0° to 135°, 0° to 120°, 0° to 90°, 0° to 45°, 0° to 30°, and 0° to 15°. The open position of the outer panel 56 may comprise an angle $\alpha$ greater than 0°. The inner panel 54 may pivot along the binding edge from a minimum angle $\beta$ of 0° when in a closed position to a maximum angle $\beta$ of 270° when in an open position. The inner panel 54 may pivot along the binding edge from an angle $\beta$ 0° to 270°, 0° to 240, 0° to 225°, 0° to 210°, 0° to 180°, 0° to 120°, 0° to 90°, 0° to 45°, 0° to 30°, and 0° to 15°. The open position of the inner panel 54 may comprise an angle $\beta$ greater than 0°. The outer panel 56 may pivot along the hinge line 52 from an angle $\alpha$ −90° to 180°, −10° to 180°, 0° to 180°, 0° to 135°, 0° to 120°, 0° to 90°, 0° to 45°, 0° to 30°, and 0° to 15°, and the inner panel 54 may pivot along the binding edge from an angle $\beta$ 0° to 270°, 0° to 240, 0° to 225°, 0° to 210°, 0° to 180°, 0° to 120°, 0° to 90°, 0° to 45°, 0° to 30°, and 0° to 15°.

The angles of the inner panel $\beta$ and outer panel $\alpha$ when in the closed position may be the same and the angles of the inner panel $\beta$ and outer panel $\alpha$ when in the open position may be the same or different. The angle of the inner portion $\beta$ may be less than the angle of the outer portion $\alpha$ when in the open position. The angle of the inner portion $\beta$ may be greater than the angle of the outer portion $\alpha$ when in the open position.

The outer panel 56 may comprise a corner portion that pivots about a second hinge line in a forward direction (e.g., an angle less than 0°) and a backward direction (e.g., an angle greater than 0°) relative to a plane including the outer panel 56. The second hinge line may extend from a top edge to the free edge of the outer panel 56. The corner portion may be pivotable about the second hinge line between a closed position and an open position from an angle $\gamma$ of 0° to 270°. The corner portion may pivot along the second hinge line from a minimum angle $\gamma$ of −90°, −10°, or 0° when in a closed position to a maximum angle $\gamma$ of 180° or 270° when in an open position. The corner portion may pivot along the second hinge line from an angle $\gamma$ −90° to 180°, −10° to 180°, 0° to 180°, 0° to 135°, 0° to 120°, 0° to 90°, 0° to 45°, 0° to 30°, and 0° to 15°. The outer panel 56 may pivot along the hinge line 52 from an angle $\alpha$ −90° to 180°, −10° to 180°, 0° to 180°, 0° to 135°, 0° to 120°, 0° to 90°, 0° to 45°, 0° to 30°, and 0° to 15°, the corner portion may pivot along the second hinge line from an angle $\gamma$ −90° to 180°, −10° to 180°, 0° to 180°, 0° to 135°, 0° to 120°, 0° to 90°, 0° to 45°, 0° to 30°, and 0° to 15°, and the inner panel 54 may pivot along the binding edge from an angle $\beta$ 0° to 270°, 0° to 240, 0° to 225°, 0° to 210°, 0° to 180°, 0° to 120°, 0° to 90°, 0° to 45°, 0° to 30°, and 0° to 15°.

Each cover 40, 50 may comprise a variety of shapes and dimensions and rigidness greater than the sheets 20 therein to provide protection and/or support to such sheets 20. For example, each of the covers 40, 50 may have a width (i.e., extending generally perpendicular to the binding edge) of between 2 to 12 inches and a height (i.e., extending generally parallel to the binding edge) of between 2 to 14 inches. Each of the covers 40, 50 may comprise a thickness from 0.01 to 0.5 inches. The notebook cover 30 may be effectively sized to generally support and closely receive various paper sizes, e.g., index cards, letter size paper, legal size paper, A4 size paper, and ledger size paper. The covers 40, 50 may be effectively sized to generally support and closely receive 2 by 2 inch to 12 by 14 inch sheets of paper therein. The covers 40, 50 may be effectively sized to generally support and closely receive 3 by 5 inch to 8.5 by 11 inch sheets of paper therein. Each of the front cover 40, back cover 50, and spine 60 may independently comprise a generally flat and planar and generally rectangular shape or generally square shape in front view.

Referring to FIG. 2, when the notebook 10 is in its fully closed position and the back cover 50 is in its closed position, the inner surface of the inner 54 and outer 56 panels may abut against, face, or may be located adjacent to, the free inner sheet 20 or front cover 40. Thus, in this manner, the inner 54 and outer 56 panels may act as a back cover 50 for the notebook 10 to protect and/or support the sheets 20 therein. When the notebook 10 is in its fully opened position and the back cover 50 is in its open position, the inner surface of the inner 54 and outer 56 panels may not abut against, face, or may not be located adjacent to, the free inner sheet 20 or front cover 40.

When the notebook 10 is in a partially opened position, the inner surface of the inner panel 54 may abut against, face, or may be located adjacent to, the free inner sheet 20 and/or front cover 40, and the inner surface of the outer panel 56 may not abut against, face, or may not be located adjacent to, the free inner sheet 20 and/or front cover 40, as shown in FIGS. 3 and 4, or the inner surface of the outer panel 56 may abut against, face, or be located adjacent to, the free inner sheet 20 and may not abut against, face, or not be located adjacent to the front cover 40, as shown in FIG. 5. When the notebook 10 is in a partially opened position, the inner surface of the inner 54 and outer 56 panels may abut against, face, or be located adjacent to the free inner sheet 20 and may not abut against, face, or not be located adjacent to the front cover 40. When the notebook 10 is in a partially opened position, the inner surface of the inner 54 and outer 56 panels may abut against, face, or be located adjacent to at least one free inner sheet 20 and may not abut against, face, or not be located adjacent to at least one other free inner sheet 20. As shown in FIGS. 3-5, the binding mechanism may not include the free inner sheet 20. The partially opened position is between the notebook's fully opened and fully closed positions.

The inner panel 54 may pivot outwardly about the spine 60 away from the inner sheet 20 and/or front cover 40 and the outer panel 56 may pivot outwardly about the hinge line 52 away from the free inner sheet 20 and/or front cover 40 so that the back cover 50 may be opened. When the back cover 50 is opened, the outer panel 56 may be bent outward along the hinge line 52 to an angle $\alpha$ greater than 0° to expose and/or provide access to the sheets 20 therein, and the binding edge of the back cover 50 may pivot about the spine 60 to an angle $\beta$ greater than 0°. The inner panel 54 and outer panel 56 may be adjacent and coupled to each other but not in a common plane when in an open position. The inner panel 54 may be at an angle $\beta$ as described above and the outer panel 56 may be at an angle $\alpha$ as described above. For example, the inner panel 54 may be at an angle $\beta$ between 0° to less than 15° and the outer panel 56 may be at an angle $\alpha$ between 15° and 90°. The inner panel 54 may not pivot about the spine 60 and the outer panel 56 may pivot outwardly about the hinge line 52 so that the back cover 50 may be opened. When the back cover is opened, the outer panel 56 may be bent outward along the hinge line 52 to an angle $\alpha$ greater than 0° to expose and/or provide access to the sheets 20 therein, and the inner panel 54 may remain at an angle $\beta$ of 0° in the closed position.

Figure 1:
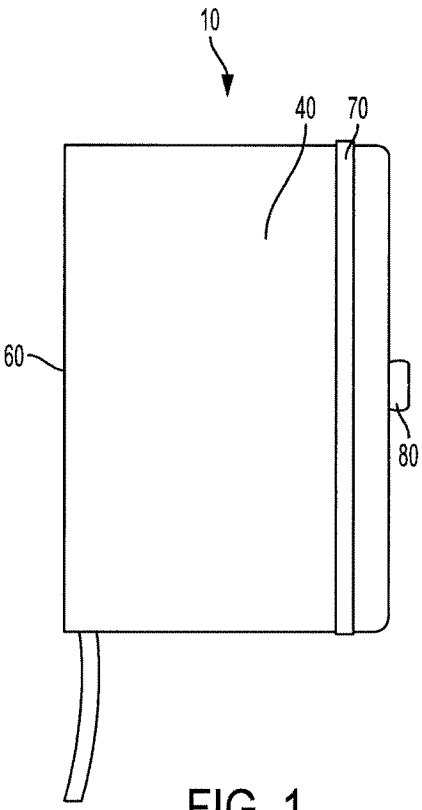
FIG. 1 includes a front view of a notebook including a notebook cover.

Referring to FIG. 1, the notebook 10 may comprise a closing mechanism 70 to selectively circumscribe the notebook 10 (e.g., the front 40 and/or back 50 covers and sheet(s) 20 of paper) to secure the notebook 10 in a closed position. The closing mechanism 70 may comprise an elastic strap that may be expanded and passed around the front 40 and back 50 covers and sheet(s) 20 of paper to secure the notebook 10 in its closed position. The elastic strap may comprise a generally stretchable solid material that may be extended when stretching forces are applied, and may sustain this extended shape while securing the notebook 10 in its closed position, but recover its general original shape when the stretching forces are removed. The elastic strap may comprise natural and/or synthetic materials, such as rubber, plastic, and fabric, for example. The closing mechanism 70 may be coupled and/or secured to the notebook cover 30 at any of a variety of locations, such as, but not limited to, the front cover 40, back cover 50, spine 60 and/or binding mechanism. The closing mechanism 70 may be located adjacent to a free edge of the back cover 50. The elastic strap may be connected to the front 40 or back 50 covers by stitching, hook-and-loop fastening material (such as VELCRO), buttons, or similar fasteners.

Referring to FIGS. 1 and 2, the notebook cover 30 may comprise a retaining mechanism 80 to retain a writing implement. The retaining mechanism 80 may comprise a snap in or strap in or slide in type holder. The retaining mechanism 80 may be coupled and/or secured the notebook cover 30 at the front cover 40, back cover 50, spine 60 and/or binding mechanism. The retaining mechanism 80 may be located adjacent to a free edge of the back cover 50. The retaining mechanism 80 may comprise an elastic loop comprising natural and/or synthetic materials, such as rubber, plastic, and fabric. The retaining mechanism 80 may be a groove set in the front cover 40, back cover 50, or spine 60 to securely couple the writing instrument to the cover 30.

A user may manipulate and open the outer panel 56 of the back cover 50 using a one- or two-hand operation of the outer panel 56. A method for using the notebook 10 or notebook cover 30 may comprise: (1) un-circumscribing the closing mechanism 70 from the front 40 and back 50 covers using at least one hand; (2) bending the back cover 50 along the spine 60 using the same hand; and (3) bending the outer panel 56 of the back cover 50 along the hinge line 52 from an angle $\alpha$ of 0° when in a closed position and an angle $\alpha$ greater than 0° when in open position using the same hand. The user may simultaneously bend an outer portion of the inner sheet 20 that may abut against, face, or be located adjacent to the outer panel 56 and may not abut against, face, or not be located adjacent to the front cover 40 when bending the outer panel 56. The user may not simultaneously bend an inner portion of the free inner sheet 20 that may abut against, face, or be located adjacent to the inner panel 54 and/or front cover 40 when bending the outer panel 56.

A method of making a notebook cover 30 may comprise simultaneously cutting, e.g., die-cutting, a unitary blank of material and scoring or creasing or binding the blank to form a cover 30 comprising first 40 and second 50 opposed covers, the first 40 cover including a first portion 54, a second portion 56, and a hinge line 52 extending therebetween, wherein the second portion 56 is pivotable about the hinge line 52 between a closed position and an open position. The method may comprise binding one sheet or a plurality of sheets 20 between the first 40 and second 50 opposed covers to form a notebook 10.

While particular embodiments have been illustrated and described, it would be obvious to those skilled in the art that various other changes and modifications may be made without departing from the spirit and scope of the present disclosure. It is therefore intended to cover in the appended claims all such changes and modifications that are within the scope of this disclosure.

What is claimed is:

1. A notebook consisting of: a plurality of sheets of paper;

a binding mechanism binding the plurality of sheets together; and a cover bound to the plurality of sheets of paper disposed therebetween, the cover comprising first and second opposed covers, the first cover including a first portion and a second portion and having a hinge line extending therebetween;

a closing mechanism coupled to at least one of the opposed covers to retain the cover in a closed position; and a retaining mechanism comprising a loop of elastic material;

wherein the second portion is pivotable about the hinge line between a closed position and an open position; and wherein the first and second opposed covers consist of a single, unitary sheet of material.

2. The notebook of claim 1, wherein the hinge line extends longitudinally from a top edge of the first cover to a bottom edge of the first cover.

3. The notebook of claim 2, wherein the notebook comprises a spine located between and coupled to the first and second opposed covers, and wherein the first and second covers each comprise a binding edge adjacent to the spine and a free edge on a generally opposite side thereof, and wherein the hinge line does not extend laterally from the binding edge to the free edge of the first cover.

4. The notebook of claim 2, wherein the cover is bound to the plurality of sheets of paper by the binding mechanism, and wherein the binding mechanism is located on an inner surface of at least one of one of the first cover, second cover, and spine.

5. The notebook of claim 3, wherein the second portion pivots about the hinge line from an angle $\alpha$, defined as the angle between the second cover and the second portion,of $-90°$ to $270°$, and the first portion is pivotable about the binding edge between a closed position and an open position from an angle $\beta$of $0°$ to $270°$.

6. The notebook of claim 5, wherein the angles $\alpha$and $\beta$are the same when the first and second portions are in the closed positions, and the angles $\alpha$and$\beta$are different when the first and second portions are in the open positions.

7. The notebook of claim 5, wherein the first and second portions facially abut against a sheet of the plurality of sheets of paper when the notebook is in a closed position, and wherein the first portion facially abuts against the sheet of the plurality of sheets of paper and the second portion does not facially abut against the sheet of the plurality of sheets of paper when the notebook is in a partially open position.

8. The notebook of claim 5, wherein the first portion facially abuts against a sheet of the plurality of sheets of paper when in a closed position and the first portion pivots about the hinge line away from the second cover when in an open position.

9. The notebook of claim 6, wherein the angle $\beta$is less than the angle $\alpha$when the first and second portions are in the open positions.

10. The notebook of claim 1, wherein the opposed covers are directly coupled together.

11. The notebook of claim 1 wherein the first cover comprises:

first and second opposed edges along a first axis; and third and fourth opposed edges along a second axis perpendicular to the first axis, and wherein the hinge line extends from the first edge to the second edge, and wherein the first cover comprises a second hinge line that extends from the first edge to the third edge.

12. The notebook of claim 11, wherein the second portion pivots about the hinge line from an angle $\alpha$, defined as the angle between the second cover and the second portion,of $-90°$ to $270°$, and the first cover comprises a third portion pivotable about the second hinge line between a closed position and an open position from an angle $\gamma$of $0°$ to $270°$.

* * * * *